US010601120B2

(12) United States Patent
Bisiules et al.

(10) Patent No.: US 10,601,120 B2
(45) Date of Patent: Mar. 24, 2020

(54) BASE STATION ANTENNAS HAVING REFLECTOR ASSEMBLIES WITH RF CHOKES

(71) Applicant: CommScope Technologies LLC, Hickory, NC (US)

(72) Inventors: Peter J. Bisiules, LaGrange Park, IL (US); Xiangyang Ai, Plano, TX (US); Joy J. Huang, Plano, TX (US); Calvin Dickerson, Garland, TX (US)

(73) Assignee: CommScope Technologies LLC, Hickory, NC (US)

( * ) Notice: Subject to any disclaimer, the term of this patent is extended or adjusted under 35 U.S.C. 154(b) by 167 days.

(21) Appl. No.: 15/921,694

(22) Filed: Mar. 15, 2018

(65) Prior Publication Data

US 2018/0337443 A1 Nov. 22, 2018

Related U.S. Application Data

(60) Provisional application No. 62/507,346, filed on May 17, 2017.

(51) Int. Cl.

| | |
|---|---|
| ***H01Q 1/24*** | (2006.01) |
| ***H01Q 1/42*** | (2006.01) |
| *H01Q 21/08* | (2006.01) |
| *H01Q 21/26* | (2006.01) |

(52) U.S. Cl.

CPC ..... *H01Q 1/246* (2013.01); *H01Q 1/42* (2013.01); *H01Q 21/08* (2013.01); *H01Q 21/26* (2013.01)

(58) Field of Classification Search

CPC ..... H01Q 1/246; H01Q 19/00; H01Q 19/022; H01Q 19/10; H01Q 19/108; H01Q 21/08; H01Q 21/26

See application file for complete search history.

(56) References Cited

U.S. PATENT DOCUMENTS

| | | | | |
|---|---|---|---|---|
| 8,928,548 | B2 | 1/2015 | Harel et al. | |
| 2006/0238427 | A1 | 10/2006 | Ferguson et al. | |
| 2010/0117916 | A1* | 5/2010 | Gustafsson | H01Q 1/243 343/839 |
| 2016/0172765 | A1* | 6/2016 | Motta-Cruz | H01Q 1/1271 343/834 |

FOREIGN PATENT DOCUMENTS

| | | |
|---|---|---|
| KR | 2010-0015387 | 2/2010 |

OTHER PUBLICATIONS

Notification of Transmittal of the International Search Report and the Written Opinion of the International Searching Authority, or the Declaration, for corresponding International Application No. PCT/US18/22572, dated May 24, 2018, 11 pages.

Picture of Reflector and RF Chokes for Prior Art Antenna 1. (Admitted Prior Art) (1 page).

Pictures of Reflector and RF Choke for Prior Art Antenna 2. (Admitted Prior Art) (1 page).

Pictures of Reflector and RF Chokes for Prior Art Antenna 3. (Admitted Prior Art) (1 page).

* cited by examiner

*Primary Examiner* — Robert Karacsony
(74) *Attorney, Agent, or Firm* — Myers Bigel, P.A.

(57) ABSTRACT

A base station antenna includes a reflector assembly and a linear array of radiating elements extending forwardly from the reflector assembly. The reflector assembly includes an RF choke that has a choke body and a choke cover. The choke cover at least partially covers a choke body opening so that a choke opening of the RF choke is smaller than the choke body opening.

19 Claims, 8 Drawing Sheets

BASE STATION ANTENNAS HAVING REFLECTOR ASSEMBLIES WITH RF CHOKES

CROSS-REFERENCE TO RELATED APPLICATION

The present application claims priority under 35 U.S.C. § 119 to U.S. Provisional Patent Application Ser. No. 62/507,346, filed May 17, 2017, the entire content of which is incorporated herein by reference as if set forth in its entirety.

BACKGROUND

The present invention generally relates to wireless communications and, more particularly, to base station antennas for cellular communications systems.

Cellular communications systems are well known in the art. In a cellular communications system, a geographic area is divided into a series of regions that are referred to as "cells," and each cell is served by a so-called "macrocell" base station. The macrocell base station supports two-way radio frequency ("RF") communications with mobile subscribers that are geographically positioned within the cell served by the base station. In many cases, each macrocell base station is divided into multiple "sectors," and different base station antennas, radios and other equipment are used to provide cellular service in each sector. For example, in a common configuration, a base station may be divided into three sectors, and each base station antenna is designed to provide coverage for about 120° in the azimuth plane. The base station antennas may be mounted on a tower or other raised structure, with the radiation beam(s) that are generated by each antenna directed outwardly to serve the respective sector. In some cases, so-called small cell base stations may also be added within a macrocell to provide additional capacity to a small portion of the cell.

Most macrocell base station antennas comprise one or more linear arrays of radiating elements that are mounted on a flat panel reflector assembly. The reflector assembly may serve as a ground plane for the radiating elements, and may also reflect RF energy that is emitted rearwardly by the radiating elements back in the forward direction. FIGS. 1A and 1B are a perspective view and a cross-sectional view, respectively, of a conventional reflector assembly 10. The reflector assembly 10 may be part of a base station antenna. The reflector assembly 10 has a front 12, a back 14 and first and second sides 16. As, can be seen in FIGS. 1A-1B, the conventional reflector assembly 10 may comprise a sheet of metal, such as aluminum, and the front 12 thereof may serve as a main reflective surface 20 that reflects RF energy. Top, bottom and side edges of the sheet metal may each be bent backwardly at an angle, such as a 90° angle. Accordingly, each side 16 of the reflector assembly 10 may have an L-shaped cross-section, as shown best in FIG. 1B. A plurality of openings 22 may be provided in the main reflective surface 20. Various elements of the base station antenna that includes the reflector assembly 10 such as, for example, the radiating elements, decoupling structures, isolation structures and/or structural supports may be mounted in the openings 22. Other of the openings 22 may include attachment structures (e.g., screws, rivets and the like) that may be used to attach various elements/structures to the reflective surface 20.

More recently, base station antennas have been introduced that have reflector assemblies that includes integrated RF chokes. FIGS. 2A and 2B are a perspective view and a cross-sectional view, respectively, of a conventional reflector assembly 30 that includes such integrated RF chokes. The reflector assembly 30 has a front 32, a back 34 and first and second sides 36. The reflector assembly 30 may comprise a sheet of metal, such as aluminum, so that the front 32 of the reflector assembly 30 acts as a main reflective surface 40 that reflects RF energy A plurality of openings 42 may be provided in the main reflective surface 40 that may serve the same functions as the openings 22 discussed above. As shown in FIGS. 2A-2B, the reflector assembly 30 differs from the reflector assembly 10 in that each side 36 of reflector assembly 30 has a U-shaped cross section (see FIG. 2B) as opposed to the L-shaped cross-section of the sides 16 of reflector assembly 10. The U-shaped sides 36 of the reflector assembly 30 form U-shaped channels that run the length of the antenna and act as RF chokes 44. An RF choke is a circuit element that allows some currents to pass, but which is designed to block or "choke" currents in certain frequency bands. The antenna that includes reflector assembly 30 will have one or more linear arrays of radiating elements. Each RF choke 44 (i.e., the U-shaped channels) may have an electrical path length (i.e., the sum of the lengths of each side and the bottom of the U-shape) that corresponds to a 180° phase shift at the center frequency of the frequency band at which one of the linear arrays of radiating elements of the antenna radiates RF energy. Consequently, RF currents that are carried outwardly on the reflective surface 40 may pass down the inner side of the RF choke 44, along the bottom thereof and then back up the outer side of the RF choke 44. As the RF signal at the top of the outer side of the U-shaped channel of the RF choke 44 is about 180° out-of-phase with the RF signal at the top of the inner side of U-shaped channel 44, these signals tend to cancel each other out.

SUMMARY

Pursuant to embodiments of the present invention, base station antennas are provided that include a reflector assembly and a linear array of radiating elements extending forwardly from the reflector assembly. The reflector assembly includes an RF choke. In some embodiments, the RF choke has a choke body and a choke cover, and the choke cover at least partially covers a choke body opening so that a choke opening of the RF choke is smaller than the choke body opening. In other embodiments, the RF choke has a choke opening that opens along a side surface of the antenna. In still other embodiments, the RF choke has a choke body and a choke cover that extends into an interior of the choke body. The RF choke may be configured to block RF signals in a frequency band of operation of the radiating elements.

In some embodiments, the choke body opening may be positioned along a front of the base station antenna while the choke opening is positioned along a side of the base station antenna.

In some embodiments, a portion of the choke cover may extend parallel to a side portion of the choke body.

In some embodiments, the choke opening is defined between an end of the choke body and a central portion of the choke cover.

In some embodiments, a path length extender may be provided that is mechanically attached to, for example, the choke body or the choke cover. The path length extender may extend into an interior of the choke body.

In some embodiments, a second RF choke may be formed within the choke cover. The second RF choke may comprise, for example, a U-shaped channel formed in the choke cover. The U-shaped channel may extend into the interior of the choke body.

In some embodiments, the choke cover includes a first lateral segment that extends parallel to a bottom portion of the choke body and a second segment that extends at an angle from the first lateral segment toward the bottom of the choke body. The second segment may be collinear with an outer segment of the choke body.

In some embodiments, the antenna may further include a radome support that has an integrated choke cover support that maintains at least a portion of the choke cover in a predetermined position.

In some embodiments, a choke body opening is positioned along a front of the base station antenna.

In some embodiments, a portion of the choke cover extends into an interior of the choke body.

DETAILED DESCRIPTION

Figure 1A:
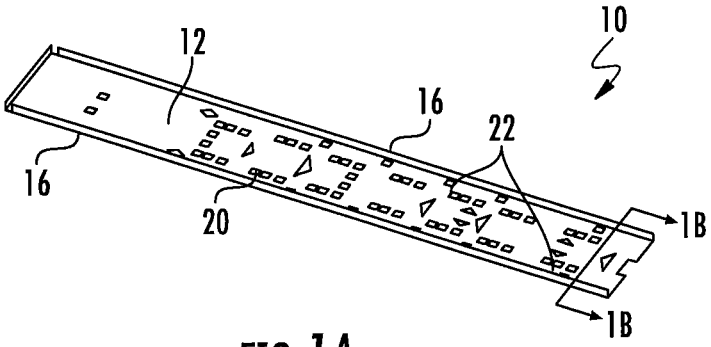
FIG. 1A PRIOR ART
FIG. 1A is a perspective view of a conventional reflector assembly for a base station antenna.
Figure 1B:
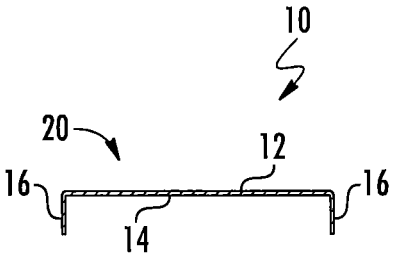
FIG. 1B PRIOR ART
FIG. 1B is a cross-sectional view taken along line 1B-1B of the reflector assembly of FIG. 1A.

Pursuant to embodiments of the present invention, base station antennas are provided that include reflector assemblies having integrated RF chokes. Each RF choke may include a choke body and a choke cover. The choke covers may be used to optimize the current paths in order to improve the azimuth beam width, azimuth pattern roll-off and/or the front-to-back ratio of one or more of the linear arrays of the base station antenna. The RF chokes according to embodiments of the present invention may also improve the structural integrity of the antenna, which may be important as the current trend is to include more linear arrays, radiating elements, diplexers and other filters on base station antennas in order to support advanced communications technologies and to slow the proliferation of the number of antennas per base station.

The choke covers included in the reflector assemblies according to embodiments of the present invention may be used to optimize the size and location of the opening in each choke body, which is referred to herein as the "choke opening." The choke cover may be used to reduce the size of the choke opening, which may result in better choking of RF energy in the frequency band that the RF choke is designed to block. Additionally, the choke cover may extend the ground plane of the antenna laterally, which may act to narrow the azimuth beamwidth of the antenna beams formed by the respective linear arrays of the antenna. While in many cases the RF choke may only be designed to operate as a choke in the low-band frequency range, in multi-band antennas the beneficial effect of the choke cover extending the ground plane may improve (narrow) the azimuth beamwidth of all of the frequency bands.

In some embodiments, the choke cover may be designed to move the choke opening from the front of the antenna to a side surface of the antenna. This may improve one or more of the azimuth beam width, azimuth pattern roll-off and/or the front-to-back ratio of one or more antenna radiation patterns of the antenna. Additionally, a portion of the choke cover may extend into an interior of the choke body in some embodiments. Such a design may extend the electrical path length of the RF choke, allowing it to operate at lower frequencies without expanding the size of the RF choke. In some embodiments, the choke cover may itself include a second RF choke that is used to block signals in a higher frequency band.

Base station antennas often include radome supports that are used to support a radome of the antenna. In some embodiments, the radome support may include an integrated support feature that supports the choke cover and holds it in place above the choke opening.

Embodiments of the present invention will now be described in further detail with reference to FIGS. 3A-7.

FIGS. 3A-3D are a perspective view, a front view, a cross-sectional view and an enlarged partial perspective view, respectively, of a base station antenna 100 that includes a reflector assembly 130 that includes integrated RF chokes 140. Each RF choke 140 may include a choke body 142 and a choke cover 144. In order to better illustrate the internal structure of base station antenna 100, in FIG. 3B the radome and radome supports are omitted, and the radome is omitted in FIG. 3D.

In the description that follows, the antenna 100 and the components thereof are described using terms that assume that the antenna 100 is mounted for use on a tower with the longitudinal axis of the antenna 100 extending along a vertical axis and the front surface of the antenna 100 mounted opposite the tower pointing toward the coverage area for the antenna 100, even though FIGS. 3A-3D do not depict the antenna 100 mounted in this configuration. Herein, the longitudinal direction refers to a direction that is perpendicular to the plane defined by the horizon, and the transverse direction refers to a direction that is parallel to the horizon and that extends from the center of the main reflective surface of the antenna being described towards the sides thereof.

Figure 3A:
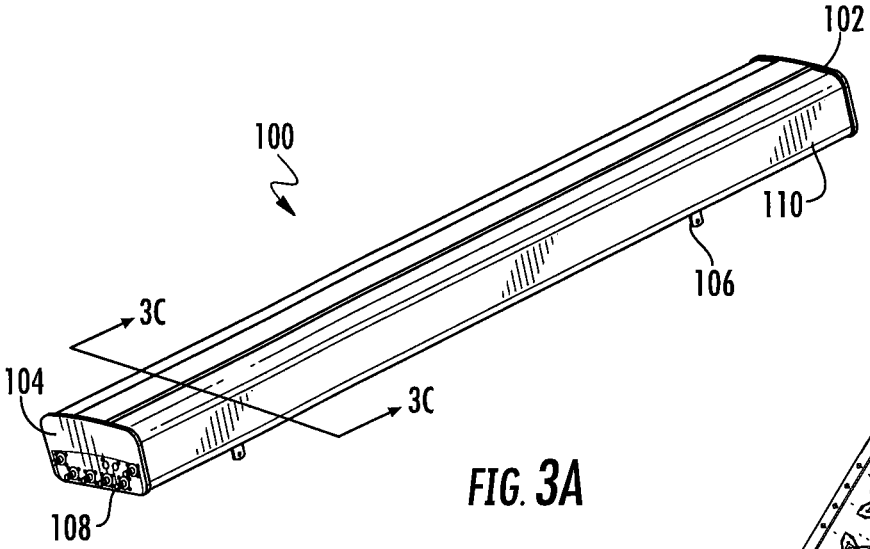
FIGS. 3A-3D are a perspective view, a front view, a cross-sectional view and an enlarged partial perspective view, respectively, of a base station antenna according to embodiments of the present invention that includes a reflector assembly having RF chokes with choke covers.

As shown in FIG. 3A, the base station antenna 100 is an elongated structure and may have a generally rectangular shape. The antenna 100 includes a top end cap 102, a bottom end cap 104 and a radome 110. The radome 110 may comprise a hollow, generally rectangular tube with a bottom opening, and may be of conventional design. The bottom end cap 104 may cover the bottom opening of radome 110. The radome 110 may be made of, for example, fiberglass. In some embodiments, the top end cap 102 and the radome 110 may comprise a single integral unit, which may be helpful for waterproofing the antenna 100. One or more mounting brackets 106 are provided on the back side of the antenna 100 which may be used to mount the antenna 100 onto an antenna mount (not shown) on, for example, an antenna tower. The bottom end cap 104 may include a plurality of connectors 108 mounted therein that receive cables that carry RF signals between base station antenna 100 and one or more associated radios. The antenna 100 is typically mounted in a vertical configuration (i.e., the long side of the antenna 100 extends along a vertical axis with respect to the horizon).

Figure 3B:
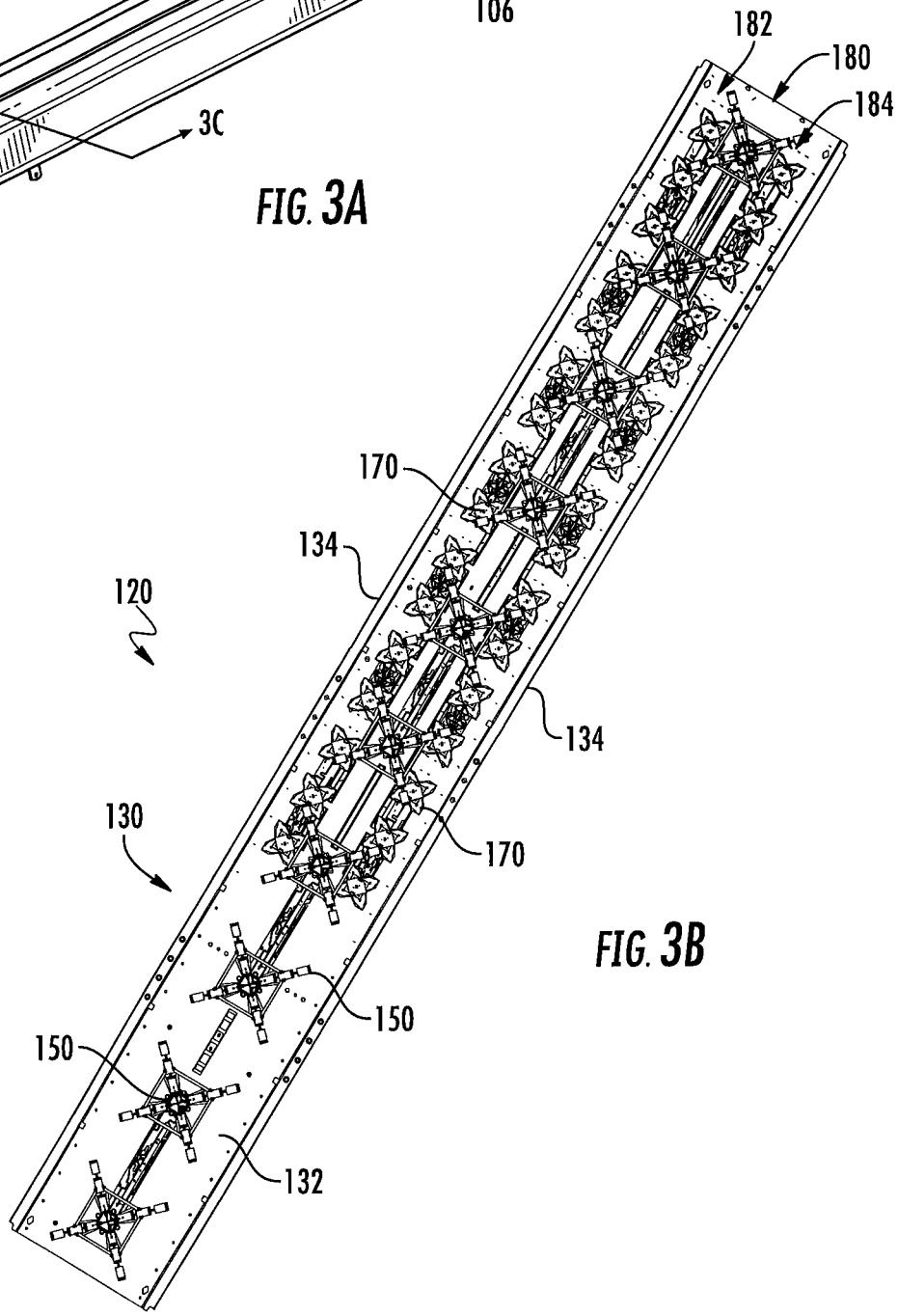

FIG. 3B is a front view of the base station antenna 100 with the radome 110 and radome supports removed. The portion of base station antenna 100 depicted in FIG. 3B is referred to herein as the antenna assembly 120. While omitted in FIG. 3B to better illustrate the radiating elements, it will be appreciated that the antenna assembly 120 also includes a plurality of radome supports such as the radome support 124 shown in FIG. 3D. The antenna assembly 120 may be slidably inserted into the radome 110 through the bottom opening thereof. Referring to FIG. 3B, the antenna assembly 120 includes a reflector assembly 130 that has a main reflective surface 132 and sidewalls 134. The sidewalls 134 may extend rearwardly from the main reflective surface 132. Various mechanical and electronic components such as, for example, phase shifters, remote electronic tilt ("RET") units, mechanical linkages, diplexers, and the like (not shown) may be mounted behind the reflector assembly 130. Support brackets 122 (see FIG. 3C) may extend between the sidewalls 134 of the reflector assembly 130 to provide mechanical support.

As is further shown in FIG. 3B, a plurality of radiating elements are mounted to extend forwardly from the reflector assembly 130. The radiating elements include low band radiating elements 150 and high band radiating elements 170. The low band radiating elements 150 are mounted along a first vertical axis to form a linear array 180 of low band radiating elements 150. The high band radiating elements 170 may be divided into two groups that are mounted along respective second and third vertical axes to form a pair of linear arrays 182, 184 of high band radiating elements 170. The linear array 180 of low band radiating elements 150 extends between the two linear arrays 182, 184 of high band radiating elements 170. The low band radiating elements 150 may be configured to transmit and receive signals in a first frequency band. In some embodiments, the first frequency band may be the 694-960 MHz frequency band or a portion thereof. In other embodiments, the first frequency band may be the 555-960 MHz frequency band or a portion thereof. In other embodiments, the first frequency band may be the 575-960 MHz frequency band, the 617-960 MHz frequency band, the 694-960 frequency band or portions of any thereof. The high band radiating elements 170 may be configured to transmit and receive signals in a second frequency band. In some embodiments, the second frequency band may be the 1.695-2.690 GHz frequency range or a portion thereof.

Figure 3C:
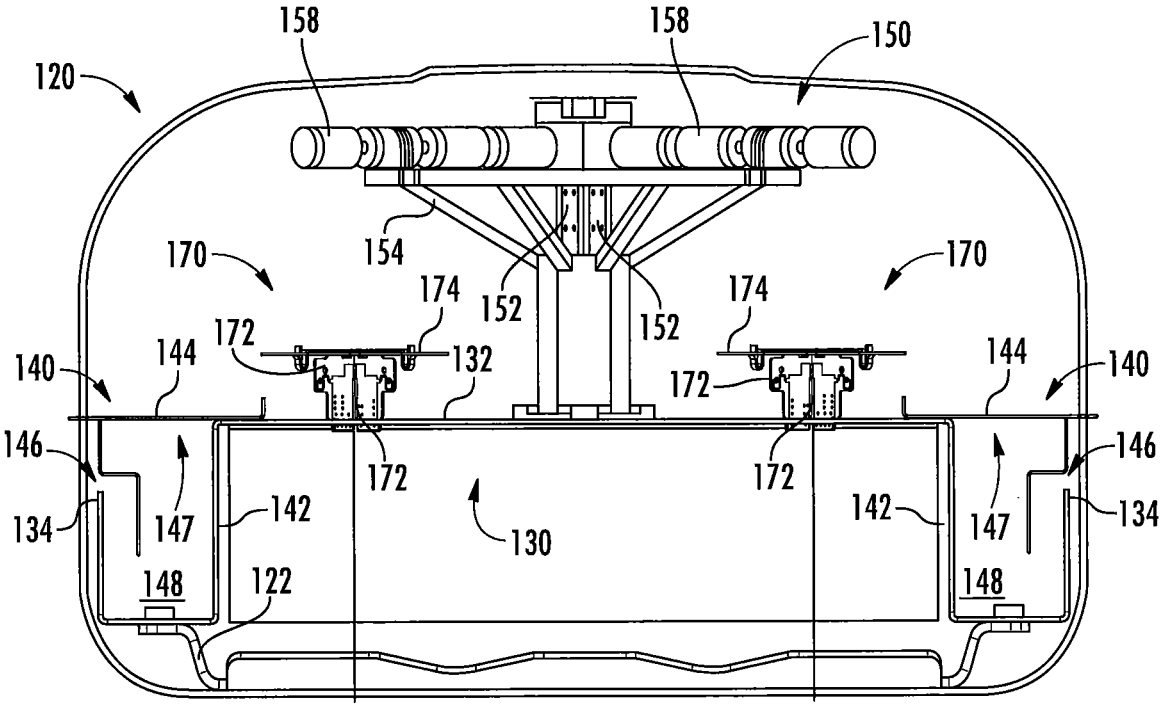
Figure 3D:
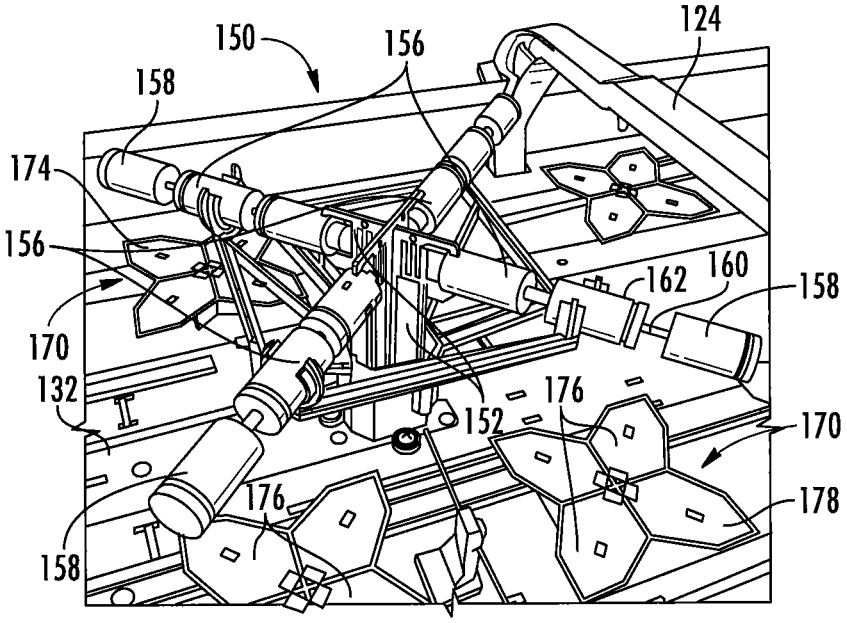

FIGS. 3C and 3D illustrate the design of the radiating elements 150, 170 in greater detail. As shown in FIGS. 3C-3D, each low band radiating element 150 includes a pair of feed stalk printed circuit boards 152, a dipole support 154 and four dipole arms 158 that form a pair of crossed dipole radiators 156. Each feed stalk printed circuit board 152 may include an RF transmission line that is part of the transmission path between each dipole radiator 156 and respective ports of a radio. Each dipole arm 158 may comprise an elongated center conductor 160 that has a series of coaxial chokes 162 mounted thereon. Each coaxial choke 162 may comprise a hollow metal tube that has an open end and a closed end that is grounded to the center conductor 160. Each dipole arm 158 may be, for example, between a ⅜ to ½ of a wavelength in length, where the "wavelength" refers to the wavelength corresponding to the center frequency of the low band. The dipole arms 158 may be arranged as two pairs of commonly fed collinear dipole arms 158. The dipole arms 158 of the first pair are commonly fed from a first of the feed stalk printed circuit boards 152 to form a first dipole radiator 156 that is configured to transmit and receive RF signals having a +45 degree polarization. The other pair of collinear dipole arms 158 are commonly fed from the second of the feed stalk printed circuit boards 152 to form a second dipole radiator 156 that is configured to transmit and receive RF signals having a −45 degree polarization. The dipole radiators 156 may be mounted approximately a quarter wavelength in front of the main reflective surface 132 by the feed stalk printed circuit boards 152. The dipole support 154 may comprise, for example, a plastic support that helps hold the dipole arms 158 in their proper positions.

As is also shown in FIGS. 3B-3D, each high band radiating element 170 includes a pair of feed stalk printed circuit boards 172 and a dipole printed circuit board 174 that has four dipole arms 178 formed thereon that form a pair of crossed dipole radiators 176. Each feed stalk printed circuit board 172 may include an RF transmission line that is part of the transmission path between each dipole radiator 176 and respective ports of a radio. Each dipole arm 178 may comprise a generally leaf-shaped conductive region on the dipole printed circuit board 174. A first pair of the dipole arms 178 are commonly fed from a first of the feed stalk printed circuit boards 172 to form a first dipole radiator 176 that is configured to transmit and receive RF signals having a +45 degree polarization. The remaining two dipole arms 178 are commonly fed from the second of the feed stalk printed circuit boards 172 to form a second dipole radiator 176 that is configured to transmit and receive RF signals having a −45 degree polarization. The dipole radiators 176 may be mounted approximately a quarter wavelength in front of the reflective surface 132 by the feed stalks 172, where the "wavelength" refers to the wavelength corresponding to the center frequency of the high band.

As shown best in FIGS. 3C-3D, the low band radiating elements 150 and the high band radiating elements 170 are mounted on the reflector assembly 130 and extend forwardly therefrom. FIG. 3D also illustrates a plastic radome support 124 that abuts the inner surface of the radome 110 when the antenna assembly 120 is installed within the radome 110. The main reflective surface 132 of the reflector assembly 130 may comprise a sheet of metal that, as noted above, serves as a reflector and as a ground plane for the radiating elements 150, 170. One or more brackets 122 may be provided on the back side of antenna assembly 120. The brackets 122 may extend between the sidewalls 134 of the reflector assembly 130 to provide mechanical rigidity thereto.

As noted above, the reflector assembly 130 includes the main reflective surface 132 and a pair of sidewalls 134 that each have a U-shaped transverse cross section (see FIG. 3C).

The sidewalls 134 having the U-shaped cross-section may extend for the full length of the antenna 100 so that the reflector assembly 130 includes a pair of U-shaped channels that may extend the full length of the antenna 100. Each U-shaped channel may be designed to form an RF choke 140. Each RF choke 140 includes a choke body 142 (which is the U-shaped channel) and a choke cover 144. The choke body 142 has a choke body opening 147 and an interior region 148. As noted above, an RF choke is a circuit element that allows some currents to pass, but which is designed to block currents in certain frequency bands. Here, the RF chokes 140 may be designed to act as RF chokes in the frequency band of the low band radiating elements 150. By providing RF chokes 140 along each side of the antenna 100, the tendency of some of the low band RF energy to radiate along the main reflective surface 132 and then off to the sides of the antenna 100 and/or behind the antenna 100 may be reduced. Consequently, the provision of the RF chokes 140 may improve the azimuth pattern roll-off and/or the front-to-back ratio of the antenna beam(s) formed by the low-band radiating elements 150.

Figure 2A:
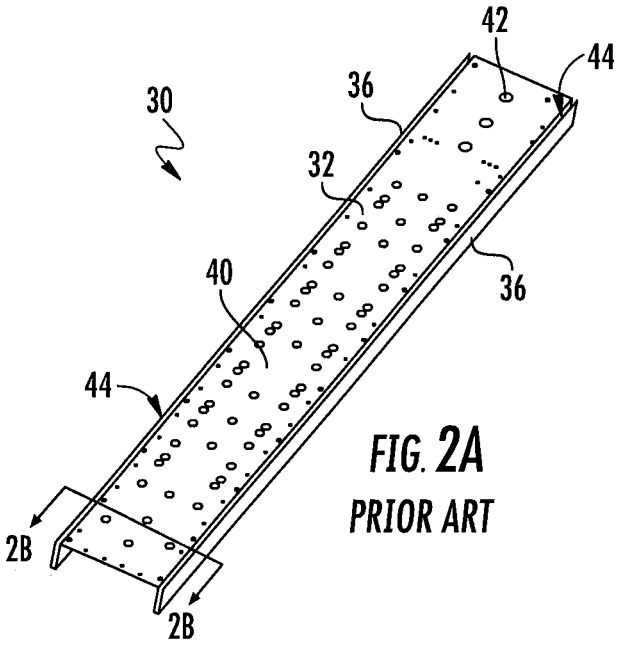
FIG. 2A PRIOR ART
FIG. 2A is a perspective view of another conventional reflector assembly for a base station antenna that includes integrated RF chokes.
Figure 2B:
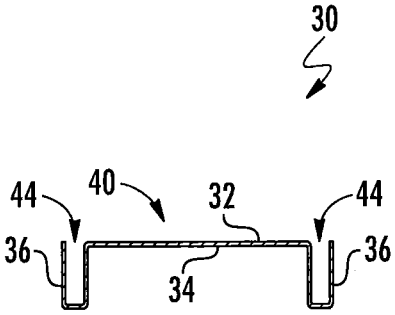
FIG. 2B PRIOR ART
FIG. 2B is a cross-sectional view taken along line 2B-2B of the reflector assembly of FIG. 2A.

As shown in FIGS. 3C-3D, the choke covers 144 partially cover the respective choke body openings 147. Accordingly, a choke opening 146 of each RF choke 140 may be made to be smaller than the choke body opening 147. The choke covers 144 may be used to improve the performance of the RF chokes 140. The choke covers 144 may be electrically connected to the reflective surface 132. For example, each choke cover 144 may be attached to the main reflective surface 132 by screws, rivets, welding, etc. As noted above, the main reflective surface 132 may be grounded and may serve as a ground plane for the radiating elements 150, 170. Since the choke covers 144 are electrically connected to the main reflective surface 132, they may effectively extend the ground plane laterally (in the transverse direction) so that the ground plane appears wider than it would if the choke covers 144 were omitted from the antenna 100 (as is the case in the prior art reflector assembly 30 discussed above with reference to FIGS. 2A-2B). The extended-width ground plane formed by the main reflective surface 132 and the choke covers 144 may advantageously help narrow the azimuth beamwidth of the antenna beams formed by the linear arrays 180, 182, 184 of low band and high band radiating elements 150, 170.

Additionally, the choke covers 144 may be used to optimize the size, shape and/or location of the choke opening 146 for each RF choke 140. Referring again to FIGS. 2A-2B, when a choke cover is not provided, the choke body opening is also the choke opening. In contrast, as shown in FIG. 3C, when a choke cover 144 is provided, the choke opening 146 may be the opening between a portion of the choke body 142 and a portion of the choke cover 144. This provides great flexibility to vary the size and location of the choke opening 146. For example, as shown in FIG. 3C, the choke covers 144 may be used to reposition the choke openings 146 from the front of antenna 100 to instead be on the respective sides of the antenna 100. Thus, the choke covers 144 may be used to vary the distance from the linear array 180 of the low band radiating element 150 to the choke openings 146 on either side of the antenna 100 without otherwise varying the width of the antenna 100. It has been found that this distance may be optimized in some embodiments to provide improved performance in terms of, for example, the front-to-back ratio, azimuth beamwidth and/or the beam roll-off in the azimuth plane for the antenna beam that is generated by the low band linear array 180. It can also be seen from FIG. 3C that the choke covers 144 may be used to provide choke openings 146 that are significantly smaller than the choke body openings 147.

An additional advantage of the choke cover 144 (as well as the other choke covers according to embodiments of the present invention that are described herein) is that they may be used to increase the electrical path length of their associated RF chokes 140. As discussed above, the RF chokes 140 may be designed so that the lengths of the current paths to the opposed sides of the choke opening 146 differ by an amount that corresponds to a phase shift of about 180° at the center frequency of the frequency band that is to be choked. When an RF choke 140 having a choke body 142 with a U-shaped cross-section is used, but the choke cover 144 is omitted, the parameters that may be used to set the phase shift at 180° are the width and the depth of the U-shaped channel of the choke body 142. Since the distance between the surfaces defining the choke opening 146 of RF choke 140 (i.e., the width of the U-shaped channel) will impact the performance thereof, the depth of the U-shaped channel may be the primary variable available for tuning the frequency of a U-shaped RF choke 140. At lower frequencies, the depth of the U-shaped channel may become large, which may increase the size of the antenna (which is generally undesirable). As base station antennas are designed to operate at lower frequency bands such as, for example, the 600 MHz frequency band, tradeoffs may start to arise between the performance of the RF chokes and the depth of the antenna.

As noted above, the choke body 142 with the U-shaped cross-section may extend for the full length of antenna 100 so that the reflector assembly 130 includes a pair of U-shaped channels that may extend the full length of the antenna 100. FIG. 6C is a partial perspective view of an antenna 700 that is similar to antenna 100 that illustrates the U-shaped channel formed by the choke body thereof in greater detail.

Figure 4A:
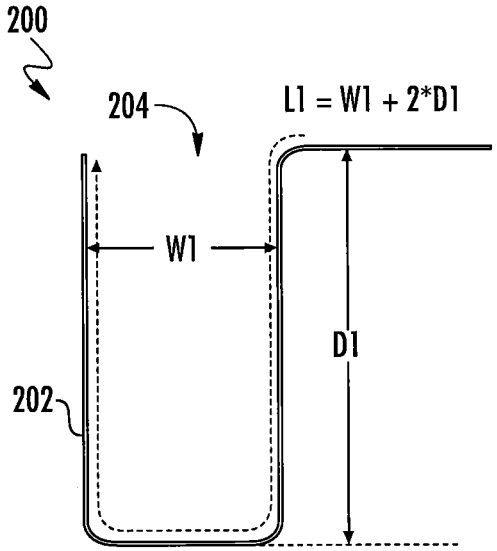
FIGS. 4A-4C are schematic views of several RF chokes that illustrate how choke covers may be used to extend the electrical path length of the RF choke.
Figure 4B:
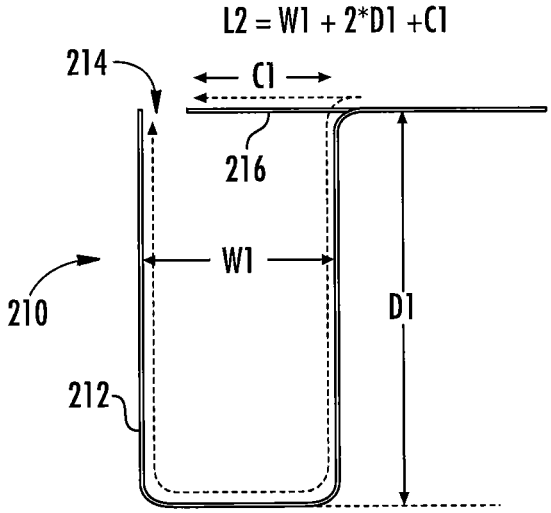
Figure 4C:
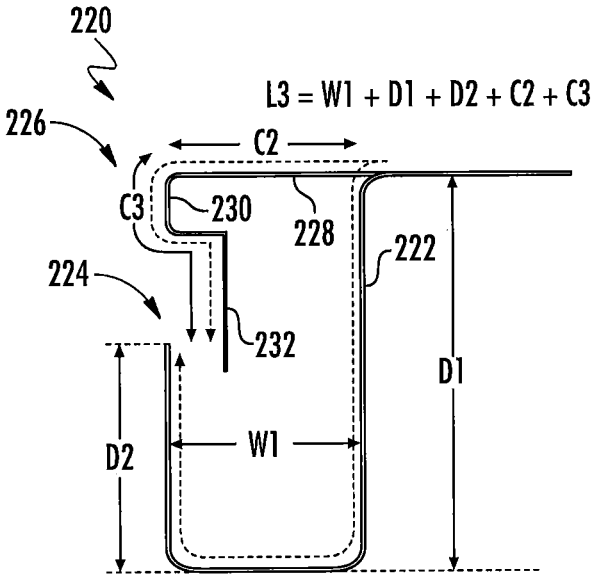

The choke covers 144 may effectively increase the overall electrical path length of the RF chokes 140, and hence may facilitate designing compact RF chokes for lower frequency bands such as, for example, the 600 MHz frequency band. This can be seen for example, with reference to FIGS. 4A-4C which illustrate three RF chokes 200, 210, 220, respectively. As shown in FIG. 4A, a conventional RF choke 200 (which has the design of the conventional RF choke 44 of FIGS. 2A-2B) includes a U-shaped choke body 202 having a choke opening 204. The electrical path length of the RF choke 200 is equal to the width W1 of the U-shaped channel plus twice the depth D1 of the U-shaped channel (i.e., electrical path length L1=W1+2*D1). FIG. 4B illustrates an RF choke 210 according to embodiments of the present invention that includes a choke body 212 having a choke opening 214 and a choke cover 216. The choke cover 216 may cover a portion of the choke opening 214. As shown in FIG. 4B, the choke cover 216 increases the electrical path length of the RF choke 210 by the width C1 of the choke cover 216. In particular, the electrical path length of the RF choke 210 is L2=W1+2*D1+C1. As can be seen from FIG. 4B, adding the choke cover 216 allows the electrical path length to be increased without increasing the physical size of the RF choke. FIG. 4C illustrates another RF choke 220 according to embodiments of the present invention that has a choke body 222, a choke opening 224 and a choke cover 226. As can be seen, while the choke body 222 still has a generally U-shaped cross-section, the outer arm of the U-shape does not extend as high as the inner arm. Moreover, the choke cover 226 not only includes a laterally extending portion 228, but further includes first and second rearwardly extending portions 230, 232 that are laterally offset from each other (segments 230, 232 extend downwardly in FIG. 4C, but will extend rearwardly when an antenna including RF choke 220 is mounted for use). As a result, the choke opening 224 is moved to a side surface of the antenna instead of being forwardly pointing. Two rearwardly extending portions 230, 232 are provided since portion 230 allows the electrical path length to be further increased while portion 232 may be positioned to provide a desired width for the choke opening 224. As shown in FIG. 4C, the choke cover 226 increases the electrical path length of the RF choke 220 by the distance C2+C3 of the choke cover 226. Accordingly, the electrical path length of the RF choke 220 is L3=W1+D1+D2+C2+C3. As can be seen from FIG. 4C, D2+C3>D1, and thus the RF choke 220 will have a greater electrical path length than the RF choke 210 of FIG. 4B. Thus, FIG. 4C shows that by providing non-planar choke covers it may be possible to further increase the electrical path length.

Additionally, the choke covers according to embodiments of the present invention allow the size of the choke opening to be selected essentially independent of path length considerations. As such, the choke openings can be made much smaller without impacting the frequency tuning of the RF choke. Such smaller openings may exhibit high coupling levels between currents on each side of the RF choke, and hence may exhibit improved cancellation (i.e., improved RF choke performance).

Figure 7:
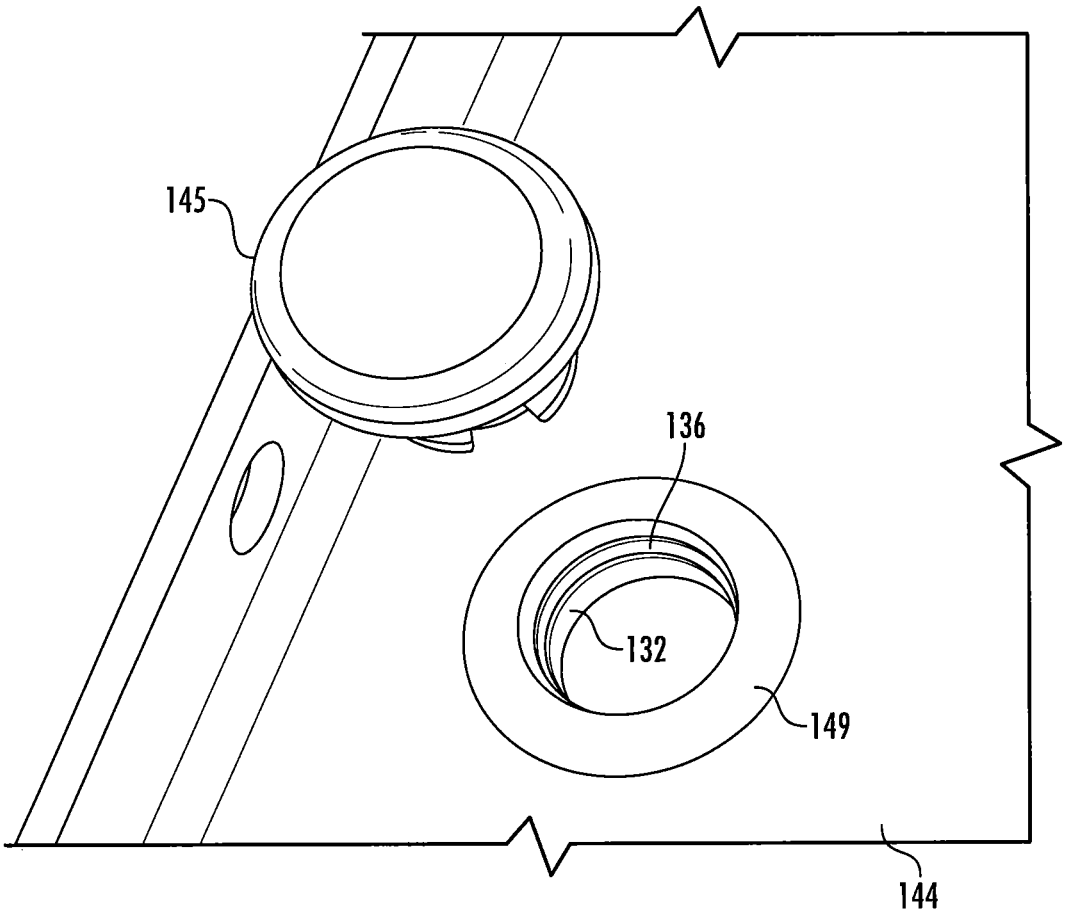
FIG. 7 is an enlarged perspective view of a portion of a choke cover according to embodiments of the present invention illustrating how the choke cover may be attached to an underlying reflector assembly.

Advantageously, the RF chokes according to some embodiments may be formed by bending/stamping sheet metal, and hence may be relatively inexpensive to manufacture. The choke covers according to embodiments of the present invention may likewise be formed by bending/stamping sheet metal. The choke covers may be attached to the antenna in any conventional manner. For example, the choke covers may be riveted to the reflective surface 132. In some embodiments, the choke cover may be capacitively coupled to the reflector. For example, a thin insulating gasket or spacer formed of, for example, mylar, may be interposed between the choke cover and the reflector surface. In such embodiments, plastic rivets, screws or other fasteners may be used to connect the choke cover to the reflector to avoid direct metal-to-metal contact that could be a potential source of PIM. In some embodiments, a dimple feature may be provided on the chock cover surrounding the apertures for the fasteners. This dimple feature may help avoid direct metal-to-metal contact between the choke cover and the reflector. FIG. 7 is an enlarged view of a portion of the choke cover 144 that illustrates one of the connection points where the choke cover 144 is attached to the underlying reflector assembly 130 via a plastic fastener 145. A mylar spacer 136 is visible in FIG. 7 that spaces the choke cover 144 apart from the main reflective surface 132 of reflector assembly 130, as is an example dimple 149. The U-shaped channels included in the RF chokes and the choke covers may also improve the structural integrity of the base station antenna.

Referring now to FIGS. 5A-5D, base station antennas that include reflector assemblies according to further embodiments of the present invention having RF chokes with choke covers are depicted. It will be appreciated that FIGS. 5A-5D only illustrate a small portion of a transverse cross-section of each base station antenna that shows the various RF chokes and choke covers that are provided on one side of the antennas of FIGS. 5A-5D. It will be appreciated that RF chokes may be provided along each side of the antenna. The antennas 300, 400, 500, 600 that are depicted in FIGS. 5A-5D may be identical to the antenna 100 described above with reference to FIGS. 3A-3D except for the depicted variations in the RF choke and choke cover designs.

Figure 5A:
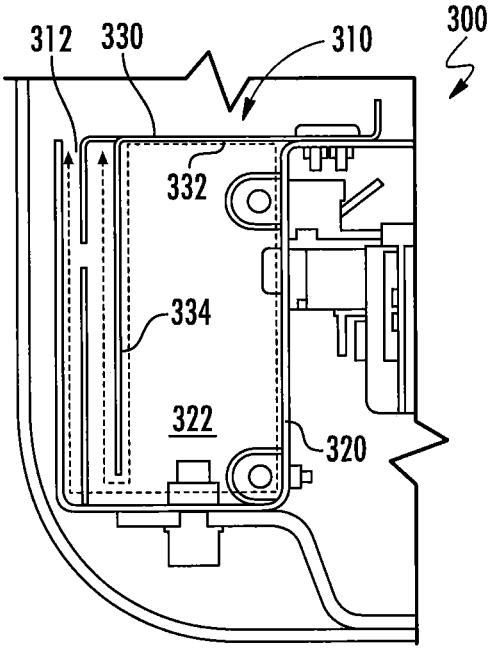
FIGS. 5A-5D are schematic cross-sectional views of portions of base station antennas that have reflector assemblies with integrated RF chokes with choke covers according to further embodiments of the present invention.

Referring first to FIG. 5A, a base station antenna 300 is depicted that includes an RF choke 310 that includes a choke body 320 and a choke cover 330. The choke body 320 has a U-shaped cross-section and may be conventional in design. The sides and bottom of the "U" define an interior 322 of the choke body 320. The RF choke cover 330 includes a laterally extending segment 332 and a rearwardly extending segment 334. The choke body 320 and choke cover 330 together define a choke opening 312 into the interior of the choke body 320.

As shown in FIG. 5A, the lateral segment 332 of the choke cover 330 acts to narrow the choke opening 312. Consequently, stronger coupling may be achieved between signals on either side of the choke opening 312. The lateral segment 332 of the choke cover 330 also extends the electrical path length of the RF choke 300. As is further shown in FIG. 5A, the rearwardly extending segment 334 of the choke cover 300 extends into the interior 322 of the choke body 320. The rearwardly extending segment 334 may thus further increase the electrical path length of the RF choke 300. The electrical path length of the choke is shown in FIG. 5A by a pair of dashed arrows. The sum of the lengths of the two dashed arrows represent the total electrical path length of the RF choke 300.

Figure 5B:
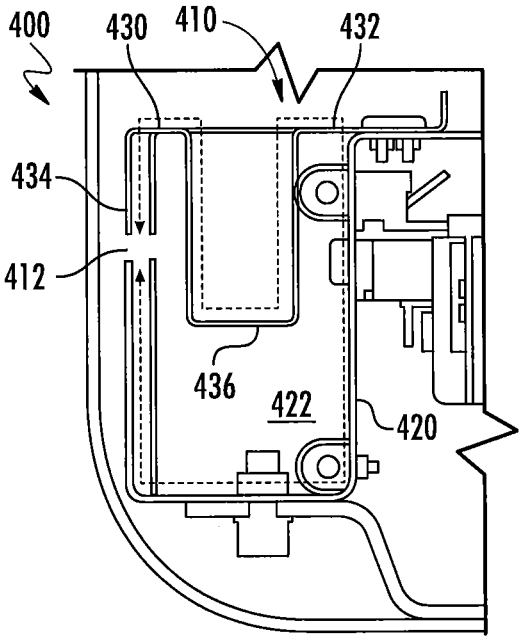

FIG. 5B depicts a portion of a base station antenna 400 that includes an RF choke 410 that has a choke body 420 and a choke cover 430. The choke body 420 has a generally U-shaped cross-section, but the outer arm of the "U" does not extend as far forwardly as the inner arm of the "U." The sides and bottom of the "U" define an interior 422 of the choke body 420. The RF choke cover 430 again includes a laterally extending segment 432 and a rearwardly extending segment 434. However, in the choke cover design of FIG. 5B, the laterally extending segment 432 includes a U-shaped indentation 436. The U-shaped indentation 436 in the choke cover extends into the interior 422 of the choke body 420. The U-shaped indentation 436 in the choke cover 430 may significantly increase the electrical path length. By shortening the outer arm of the U-shaped choke body 420, it is possible to move the choke opening 412 around to the side of the antenna, as shown in FIG. 5B. This may enhance the performance of the RF choke in some situations. The choke cover 430 may be designed so that the choke opening 412 is reasonably narrow. The electrical path length of the choke 410 is shown in FIG. 5B by a pair of dashed arrows. The sum of the lengths of the two dashed arrows represent the total electrical path length of the RF choke 400.

In some embodiments, the U-shaped indentation 436 in the choke cover 430 may be designed to act as a second RF choke. For example, the antenna 400 may be a multiband antenna that includes linear arrays of both low band and high band radiating elements. In such an antenna, the U-shaped indentation 436 in the choke cover 430 may be designed to act as an RF choke for RF signals in the high band. Notably, this second RF choke may be implemented without any increase in the size of the choke RF 400.

Figure 5C:
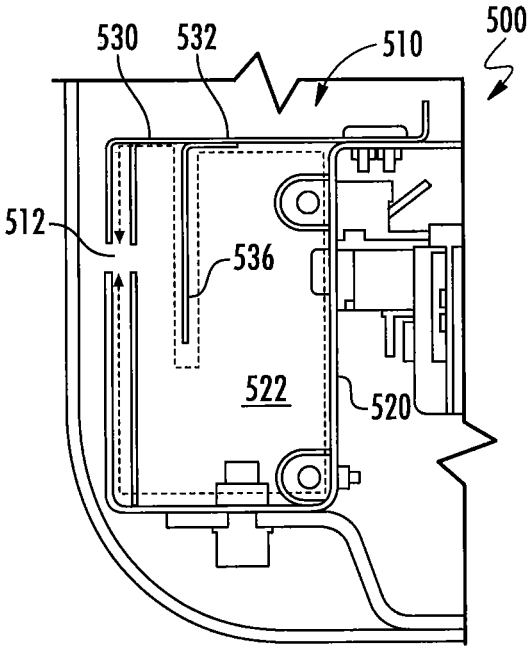

FIG. 5C depicts a portion of a base station antenna 500 that includes an RF choke 510 that has a choke body 520 and a choke cover 530. The choke body 520 may be identical to the choke body 420 of RF choke 400, and hence further description thereof will be omitted. The choke cover 530 is similar to the choke cover 430 of RF choke 410, except that it does not include the U-shaped indentation 436. The choke opening 512 is again provided on the side of the RF choke. The choke cover 530 further includes a path length extender 536 that extends into the interior 522 of the choke body 520. The path length extender 536 may comprise a separate part that is attached (e.g., by rivets, welding, etc.) to the lateral segment 532 of the choke cover 530 or, alternatively, the choke cover 530 may be a monolithic structure that includes the path length extender 536 as fabricated. The path length extender 536 may significantly increase the electrical path length. The electrical path length of the RF choke 510 is the sum of the lengths of the two dashed arrows shown in FIG. 5C.

Figure 5D:
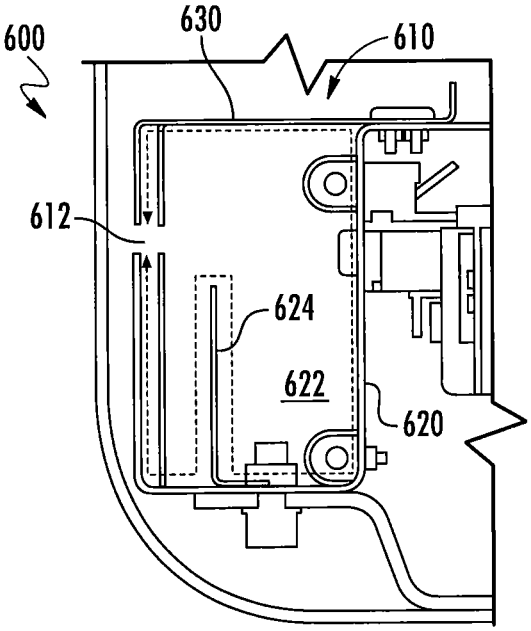

FIG. 5D depicts a portion of a base station antenna 600 that includes an RF choke 610 that has a choke body 620 and a choke cover 630. The choke body 620 may be identical to the choke body 420 of RF choke 400, and hence further description thereof will be omitted. The choke cover 630 is identical to the choke cover 530 of RF choke 500, except that the path length extender 536 is omitted in choke cover 630. The choke opening 612 is provided on the side of the RF choke 600. The choke body 620 further includes a path length extender 624 that extends into the interior 622 of the choke body 620. The path length extender 624 may comprise a separate part that is attached (e.g., by rivets, welding, etc.) to the choke body 620, alternatively, the choke body 620 may be a monolithic structure that includes the path length extender 624 as fabricated. The path length extender 624 may significantly increase the electrical path length. The electrical path length of the RF choke 610 is the sum of the lengths of the two dashed arrows shown in FIG. 5D.

As noted above, the antenna 100 of FIGS. 3A-3D includes a plurality of radome supports 124. The radome supports 124 may comprise, for example, generally U-shaped plastic supports that have opposed arms that extend forwardly from the reflective surface 132 and a cross-bar that extends between the arms. The radome supports 124 may be spaced apart from each other along the length of the antenna 100. The radome supports 124 may act as a guide when antenna assembly 120 is installed within the radome 110. In particular, the radome supports 124 may help ensure that the radome 110 does not contact elements of the antenna assembly 120 when the antenna assembly 120 is slid within the radome 110. The radome supports 124 may also protect elements of the antenna 100 such as the low band radiating elements 150 from deflection of the radome 110 during use under wind loading.

According to further embodiments of the present invention, one or more of the radome supports may also include integrated supports that hold choke covers in desired positions. As discussed above, the choke covers may be formed by stamping and/or bending a thin piece of sheet metal. Given the wind loads that may be experienced by a base station antenna, the choke covers, if not properly supported, may move within the antenna. Such movement may impact the electrical path length of the RF choke, moving it away from a desired value such as 180°. In an extreme situation, such movement may even result in a short circuit being formed. The choke cover supports that are integrated into the radome supports may be used to hold the choke covers in desired positions so that the electrical performance of the RF choke may be optimized.

Figure 6A:
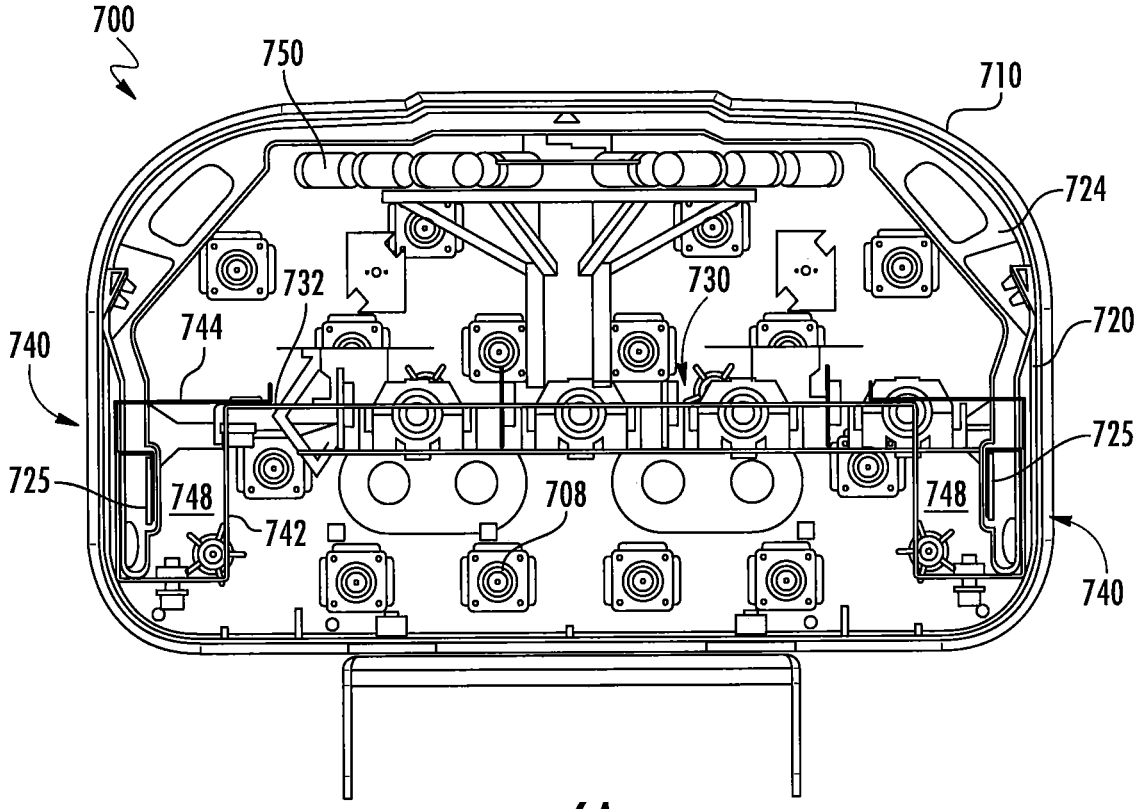
FIG. 6A is a cross-sectional view of a base station antenna according to further embodiments of the present invention.
Figure 6B:
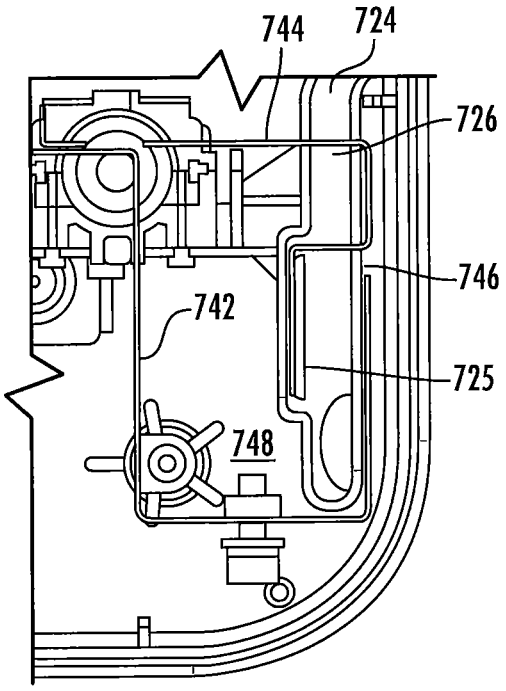
FIG. 6B is an enlarged view of a portion of FIG. 6A that illustrates an integrated choke cover support included in a radome support of the antenna.
Figure 6C:
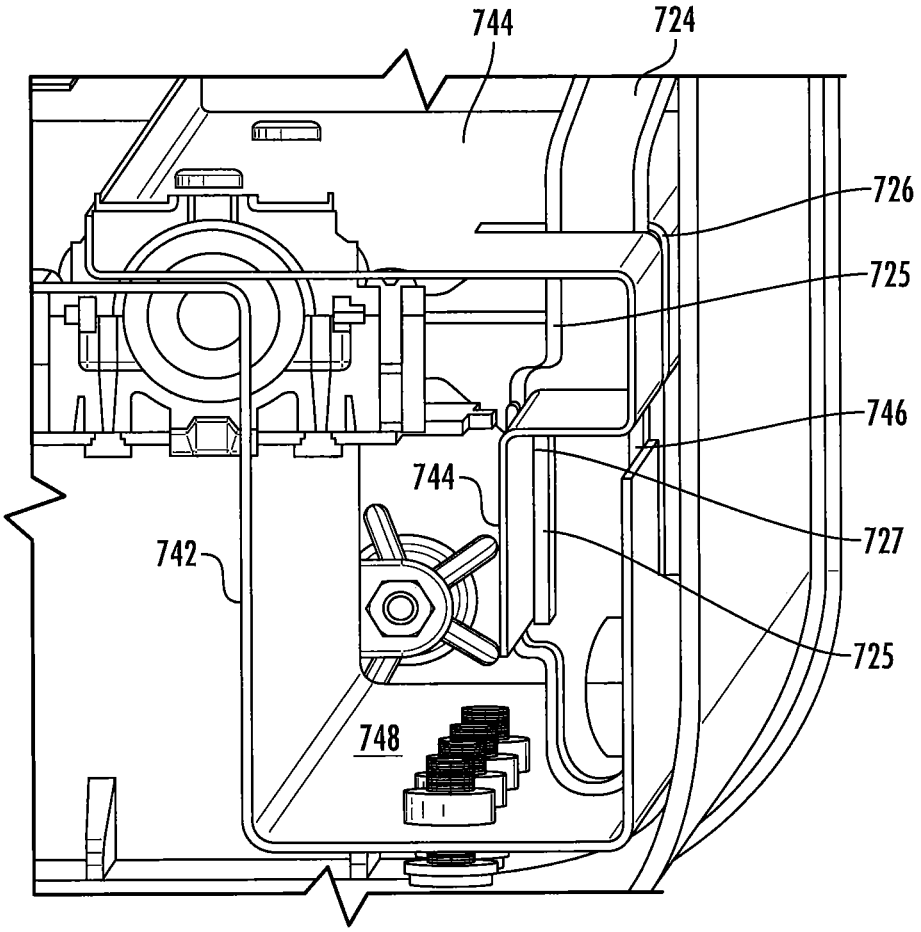
FIG. 6C is a perspective cross-sectional view corresponding to the view of FIG. 6B.
Figure 6D:
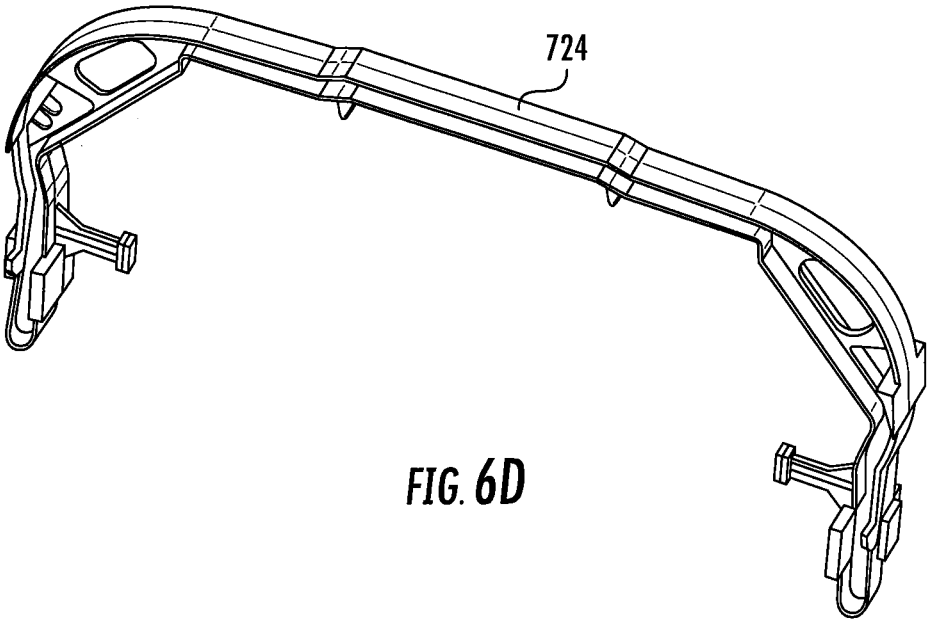
FIG. 6D is a perspective view of the radome support shown in FIGS. 6A-6C.

FIGS. 6A-6D illustrate a base station antenna 700 according to embodiments of the present invention that includes radome supports that have integrated choke cover supports. In particular, FIG. 6A is a cross-sectional view of a base station antenna 700 that includes a plurality of radome supports 724, only one of which is visible in the views of FIGS. 6A-6D. FIG. 6B is an enlarged view of a portion of FIG. 6A that illustrates one of the integrated choke cover supports 725 in further detail. FIG. 6C is a perspective cross-sectional view corresponding to the view of FIG. 6B. Finally, FIG. 6D is a perspective view of the radome support 724.

As shown in FIGS. 6A-6D, the base station antenna 700 includes a plurality of connectors 708, a radome 710 and an antenna assembly 720. The antenna 700 includes radiating elements 750, only one of which is visible in the figures. The antenna 700 may also include high band radiating elements (not shown). The antenna 700 further includes a reflector assembly 730 having a main reflective surface 732 and a pair of integrated RF chokes 740 that each have a choke body 742 and a choke cover 744. The choke body 742 and the choke cover 744 define a choke opening 746, and a portion of the choke cover 744 extends into an interior 748 of the choke body 742. The connectors 708, radome 710 antenna assembly 720, reflector assembly 730, RF chokes 740 and radiating elements 750 may be identical to the corresponding (and similarly numbered) elements of base station antenna 100, and hence further description thereof will be omitted here.

The radome supports 724 differ from the radome supports 124 described above in that the radome supports 724 include one or more integrated choke cover support features. In the depicted embodiment, each arm of the radome support 724 includes a pair of lips 725 that define a channel 727 therebetween. An edge of the choke cover 744 may be received within this channel 727. As shown best in FIG. 6C, the choke cover 744 may include slits 745 that allow the radome support 724 to extend through the choke cover 744.

It will be appreciated that many modifications may be made to the reflector assemblies described above without departing from the scope of the present invention. For example, the choke bodies and choke covers may have any geometry that moves the choke opening to a side of the reflector assembly. As another example, the choke covers or choke bodies may include any shaped extensions that increase the electrical path length, and these extensions may be located in any appropriate position.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna, comprising:

a reflector assembly; and a linear array of radiating elements extending forwardly from the reflector assembly, wherein the reflector assembly includes an RF choke that has a choke body and a choke cover, wherein the choke cover at least partially covers a choke body opening so that a choke opening of the RF choke is smaller than the choke body opening, wherein the choke opening is defined between an end of the choke body and a central portion of the choke cover, and wherein the choke body opening is positioned along a front of the base station antenna while the choke opening is positioned along a side of the base station antenna.

2. The base station antenna of claim 1, wherein a portion of the choke cover extends into an interior of the choke body.

3. A base station antenna, comprising:

a reflector assembly; and a linear array of radiating elements extending forwardly from the reflector assembly, wherein the reflector assembly includes an RF choke that has a choke body and a choke cover, wherein the choke cover at least partially covers a choke body opening so that a choke opening of the RF choke is smaller than the choke body opening, wherein the choke body includes a path length extender that extends into an interior of the choke body.

4. The base station antenna of claim 1, wherein a second RF choke is formed within the choke cover.

5. A base station antenna, comprising:

a reflector assembly;

a linear array of radiating elements extending forwardly from the reflector assembly, wherein the reflector assembly includes an RF choke that has a choke body and a choke cover, the RF choke having a choke opening that opens along a side surface of the antenna, wherein a portion of the choke cover extends parallel to a side portion of the choke body, and wherein the choke body has an inner sidewall, an outer sidewall and a back wall and the inner sidewall extends more farther forwardly than the outer sidewall.

6. The base station antenna of claim 5, wherein a portion of the choke cover extends into an interior of the choke body.

7. The base station antenna of claim 5, wherein at least one of the choke body and the choke cover includes a path length extender that extends into an interior of the choke body.

8. The base station antenna of claim 5, wherein a second RF choke is formed within the choke cover.

9. The base station antenna of claim 5, further comprising a radome support, wherein the radome support includes an integrated choke cover support that maintains at least a portion of the choke cover in a predetermined position.

10. A base station antenna, comprising:

a reflector assembly;

a linear array of radiating elements extending forwardly from the reflector assembly, wherein the reflector assembly includes an RF choke that has a choke body and a choke cover that extends into an interior of the choke body, wherein the choke body has a choke body opening that opens along a front of the base station antenna and the RF choke has a choke opening that opens along a side surface of the antenna.

11. The base station antenna of claim 10, wherein the choke opening is defined between an end of the choke body and a central portion of the choke cover.

12. The base station antenna of claim 10, further comprising a path length extender that extends into an interior of the choke body that is mechanically attached to the choke cover.

13. The base station antenna of claim 10, wherein the choke body includes a path length extender that extends into an interior of the choke body.

14. The base station antenna of claim 1, wherein the RF choke is configured to block RF signals in a frequency band of operation of the radiating elements.

15. The base station antenna of claim 1, wherein a portion of the choke cover extends parallel to a side portion of the choke body.

16. The base station antenna of claim 1, further comprising a path length extender that is mechanically attached to the choke cover.

17. The base station antenna of claim 5, wherein the choke opening is defined between an end of the choke body and a central portion of the choke cover.

18. The base station antenna of claim 10, wherein the RF choke is configured to block RF signals in a frequency band of operation of the radiating elements.

19. The base station antenna of claim 1, wherein the choke body has an inner sidewall, an outer sidewall and a back wall and the inner sidewall extends more farther forwardly than the outer sidewall.

* * * * *